United States Patent [19]

Feenstra

[11] 4,116,289

[45] Sep. 26, 1978

[54] ROTARY BIT WITH RIDGES

[75] Inventor: Robijn Feenstra, Rijswijk, Netherlands

[73] Assignee: Shell Oil Company, Houston, Tex.

[21] Appl. No.: 836,259

[22] Filed: Sep. 23, 1977

[51] Int. Cl.[2] ..... E21B 9/36

[52] U.S. Cl. ..... 175/329; 175/391; 175/410

[58] Field of Search ..... 175/329, 330, 391, 392, 175/410, 415

[56] References Cited

U.S. PATENT DOCUMENTS

| | | | |
|---|---|---|---|
| 2,365,941 | 12/1944 | Crake | 175/393 |
| 2,558,415 | 6/1951 | Bonsall | 175/329 |
| 2,855,181 | 10/1958 | Olsen | 175/391 |
| 3,003,570 | 10/1961 | Roland | 175/391 |
| 3,153,458 | 10/1964 | Short | 175/393 X |
| 3,181,632 | 5/1965 | Raynal | 175/329 |
| 3,191,698 | 6/1965 | Short | 175/329 |
| 3,747,699 | 7/1973 | Feenstra et al. | 175/329 |
| 3,753,597 | 8/1973 | French | 175/393 X |
| 3,881,561 | 5/1975 | Pols et al. | 175/393 |

FOREIGN PATENT DOCUMENTS

| | | | |
|---|---|---|---|
| 1,265,943 | 5/1961 | France | 175/393 |

OTHER PUBLICATIONS

*Drilling*, Jan. 1977, pp. 73 and 74.

*Primary Examiner*—Ernest R. Purser
*Assistant Examiner*—Richard E. Favreau

[57] ABSTRACT

To allow the bit to drill in formations that behave plastically, while also protecting the bit against overloading when entering a relatively soft formation, ridge-shaped elements are provided having the ridges within the rotation alloy symmetric surface defined by the scraping edges of the scraping means (natural or artificial diamonds). The flanks of the elements are positioned at an acute angle to the said surface.

6 Claims, 9 Drawing Figures

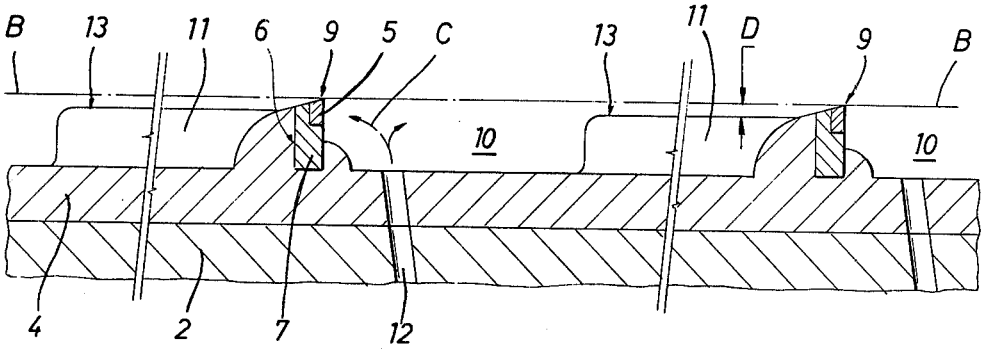
FIG. 3
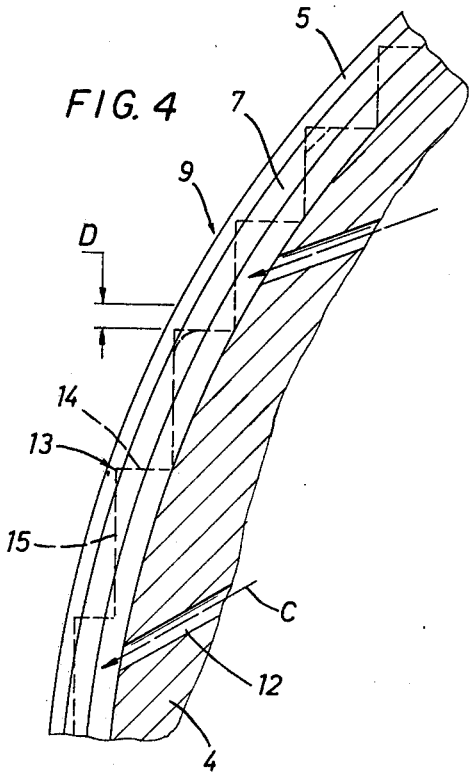
FIG. 4
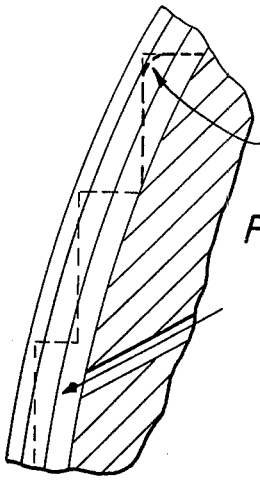
FIG. 4a
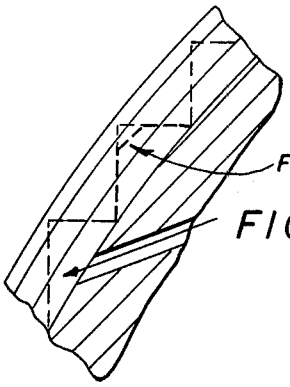
FIG. 4b
FIG. 5
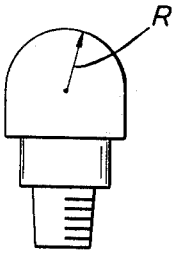
FIG. 6
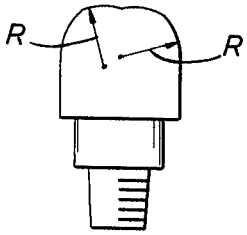
FIG. 7
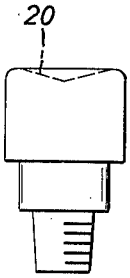

ROTARY BIT WITH RIDGES

BACKGROUND OF THE INVENTION

The invention relates to a rotary bit for drilling a hole in a subsurface formation.

In particular, the invention relates to a rotary bit comprising a body with a central axis, a plurality of mud flow channels arranged in the outer surface of the body, said channels substantially extending from a place near the central axis to body portions having the largest radius with respect to the central axis. The bit further comprises scraping means mounted on the body and having scraping edges for drilling a hole in a subsurface formation. The scraping means extend in a single row along one side of each channel and line at least part of the wall of each channel.

Such type of bit is known from U.S. Pat. No. 3,747,699. The prior art bit comprises rows of diamonds, each row being situated along a side of a mud channel such that one plane of each diamond is flush with the wall of the relevant channel. The diamonds are effectively cooled by the mud flowing through the channels and the scrapings and flour are continuously being removed from the location where they are generated during drilling operations on the scraping edges and the planes of the diamonds that are flush with the walls of the mud channel. The cuttings and flour are removed independent of the depth to which the diamonds are scraping into the formation. Consequently, this bit can be used with equally good results in soft as well as in hard formations, since the cleaning and cooling of the diamonds will be sufficient in both cases.

The performance of the bit of the above type is excellent under normal drilling conditions. However, it has been found that when designing the bit for drilling in formations that behave plastically, problems will be encountered when such bit has to drill through an interface between hard and soft rock. On the other hand, a bit designed for drilling through interfaces between hard and soft rock without damaging the bit and/or the drill string will be found to fail in formations that behave plastically. In these latter formations, the formation material is under such stress conditions that the material is being deformed by such bit without being scraped. No formation material is then being removed from the bottom of the hole in which the bit is operating and the drilling operation is halted.

When drilling through an interface between hard and soft rock, the sudden change in hardness met by the bit when passing from the hard rock into the soft rock cannot be anticipated sufficiently quickly by lowering the weight on bit. It has been found that those bits designed for drilling in formations that behave plastically, will when drilling through said interface break up rather than drill the hard formation as soon as the thickness of the latter has decreased such that it can no longer take the high bit load. The torque exerted on the bit consequently rises shockwise and the bit will be plugged and/or get stuck and/or the drill string will be damaged severely (such as be twisted off).

SUMMARY OF THE INVENTION

An object of the invention is rotary drill bit of the above mentioned type which is adapted for drilling through formations that behave plastically and is also suitable drilling through interfaces between hard and soft formations.

According to the invention, ridge-shaped elements are provided on the outer surface of the body of the bit, the elements being abrasive-resistant, being provided with non-scraping ridges that are located within the rotationally symmetric surface defined by the scraping edge of the scraping means, and having flanks that are positioned at an acute angle with respect to the said surface.

The ridges may be of curved configuration when viewed in the direction of the central axis, and may substantially extend along circles concentric to the central axis.

The scraping edges of the scraping means may be arranged such that the bottom of the hole drilled thereby is curved in the longitudinal sections thereof.

BRIEF DESCRIPTION OF THE DRAWING

The invention will, by way of example, be described in more detail with reference to the drawings which show embodiments of the invention.

FIG. 3 shows (on a larger scale than FIGS. 1 and 2) a cross-section of the bit according to FIGS. 1 and 2 taken in the direction of the arrows 3—3; and FIG. 4 shows (on the same scale as FIG. 3) a longitudinal section over a mud channel of the bit of FIGS. 1 and 2 and taken in the direction of the arrows 4—4; and FIG. **4*a* shows a longitudinal section over a mud channel indicating detail "E"; and FIG. 4*b* shows a longitudinal section over a mud channel indicating detail "F"; and FIGS. 5, 6 and 7** show side-views of bits according to the invention, having various shapes.

DESCRIPTION OF A PREFERRED EMBODIMENT

Figure 2:
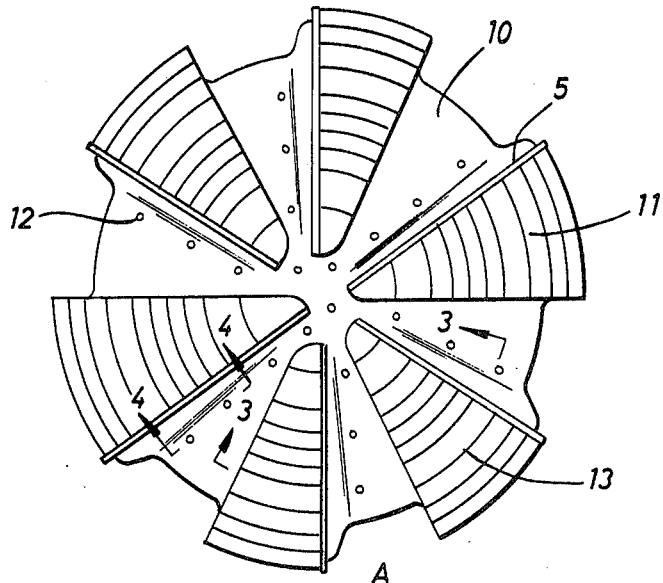
FIG. 2 shows a top view of the bit according to FIG. 1.
Figure 1:
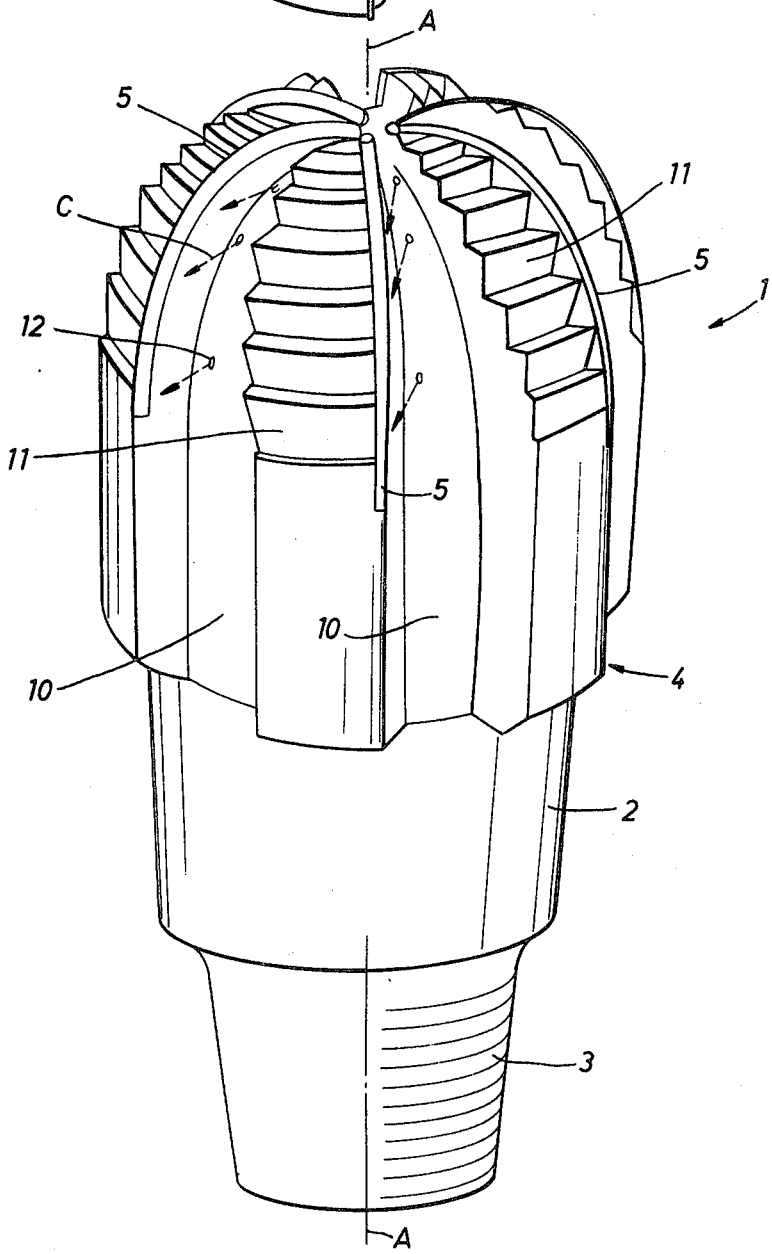
FIG. 1 is a perspective view of a bit according to the invention.

The bit as shown by way of example in FIGS. 1–4 of the drawings comprises a bit body 1 with central axis A—A around which the bit rotates when being operated in a hole for drilling purposes. The body consists of a metal insert 2 having a pin-shaped screw thread 3, the upper part of the insert 2 being covered with a coating 4 of wear-resistant material forming an outer body member. This coating 4 carries a plurality of scraping means 5 that are supportd in grooves 6 (see FIG. 3) arranged in the coating 4 through the intermediary of cam-shaped carrier bodies 7. The scraping members 5 have extremely high abrasive resistance properties and are brazed to the carrier bodies 7. Each carrier body 7 in its turn is brazed to a groove 6 or attached therein by any other means suitable for the purpose.

The scraping means 5 of the embodiment shown in the drawing have a curved configuration when viewed in the direction of the central axis A—A (see e.g. FIG. 4). Each scraping means may be formed in one piece or consist of a plurality of scraping elements that are brazed to a carrier body 7 to form a continuous scraping edge 9. The position of the scraping edges 9 of the scraping means 5 determine the shape of the bottom of the hole that can be drilling by the bit, which shape equals the rotationally symmetric surface defined by the scraping edges 9 of all the scraping means 5. This surface is indicated in FIG. 3 by the line B—B. The scraping edge 9 as shown in FIG. 4 forms the intersection between this surface and a plane passing through the central axis A—A.

Each scraping means 5 is situated between a mud channel 10 and a plurality of ridge-shaped elements 11. As shown in the drawings, at least part of the wall of each mud channel 10 is lined by scraping means 5. The mud channels 10 substantially extend from a place near the central axis A—A of the bit body 1 to body portions having the largest radius with respect to this central axis A—A.

Jet nozzles 12 for the supply of mud debouch in the mud channels 10 and are positioned such that the main direction of the flow of mud (see arrows C) from the majority of the nozzles is along and close to the lining of the channel wall formed by the scraping means 5. In the embodiment shown, the flow from each nozzle has a component in the direction towards the cutting means nearest thereto to ensure an efficient cooling and cleaning of this scraping means. Further, the flow from each nozzle has a component towards the bottom of the hole that can be drilled by the bit.

The plurality of ridge-shaped elements 11 situated at one side of each scraping means 5 is arranged in a stepwise fashion in the embodiment of the invention shown in the drawings. The elements are of abrasive resistant material since they form part of the coating 4, and the ridges 13 thereof are nonscraping ridges. These ridges are of curved configuration and extend along circles concentric to the central axis A—A (see FIG. 2). The ridges 13 are located within the rotationally symmetric surface defined by the scraping edges 9 of the scraping means 5. Each flank 14, 15 of each ridge-shaped element 11 (see FIG. 4) is arranged at an acute angle with respect to the rotationally symmetric surface defined by the scraping edges 9 for reasons that will be explained hereinafter. In the embodiment shown, the ridges 13 are situated at a distance D from the rotationally symmetric surface (see line B—B in FIG. 3) passing through the scraping edges 9 of the scraping means 5. Depending on the plasticity of the formation to be drilled, a value is chosen for this distance, which value is sufficiently great to prevent a significant contact between the ridges 13 and the formation parts that move or flow back after the passage of the scraping edges 9. A distance D in the range of 2 millimeters and smaller will be found to meet the majority of situations that will be faced during drilling.

In case the bit is drilling in a formation behaving plastically to an excessively high degree, the ridges 13 will contact the formation. However, scraping of the formation by the scraping means 5 will not be hindered by the deformation resulting from such contact, since this contact and consequently also the deformation is only locally, and moreover drilling proceeds at a normal penetration rate.

It is observed that the distance D should not be chosen too large, since thr flanks 14 of the ridge-shaped elements 11 (which flanks are situated perpendicular to the central axis A—A in the embodiment shown in the drawing) have to play a role when the bit passes from a hard formation into a relatively soft formation during drilling. Since the weight on bit cannot be reduced instantaneously during this passage from the hard formation into the soft formation, the bit tends to break through the hard formation when only a thin layer thereof is left between the bit and the soft formation. The flanks 14 of the ridge-shaped elements 11, however, come into contact with the soft formation when the bit passes through the interface between a hard and a soft formation, thereby taking up part of the weight on bit and reducing the load exerted on the scraping means 5 and the tendency to break through the layer of hard formation. By this action of the flanks 14, the scraping means are prevented from digging too deep into the soft formation parts. Moreover, any thin layer of hard rock that breaks up, is broken into small pieces by the action of the ridge-shaped elements and removed effectively towards the annulus around the drill string. Consequently, the resistance met by the rotating bit is not increased excessively when passing from a hard formation into a relatively soft formation and damage to the bit and/or the drilling string by excessive torque loads is obviated.

By arranging the ridges of adjoining rows of ridge-shaped elements (that are rows separated by a mud channel) on different circles, the thin layer of hard formation material may even more effectively be broken up and removed.

It is observed that the ridges 13 are not necessarily sharp, but may also be rounded off as shown at E in FIG. 4a, or be flat as shown at F in FIG. 4b. In this manner, a compromise may be found in case the flanks 14 of the ridge-shaped elements 11 are in a position that is optimal for reducing the load on the scraping means 5 when the bit passes through an interface between a hard and a soft formation, but the distance D between the ridge 13 and the scraping edge 9 is considered to be too small for preventing contact between the ridge and the bottom of the hole when the bit is drilling in a formation that behaves plastically to an extremely high degree. Application of shapes E and F will enlarge the distance between the ridge and the rotationally symmetric surface defined by the scraping means and obviate the said contact under these latter conditions.

The flanks 14, 15 of each ridge-shaped element 11 shound not be concentric or substantially concentric with the rotationally symmetric surface defined by the scraping means. Each of the flanks 14, 15 of each element 11 is arranged at an acute angle with respect to the said surface, and the elements 11 will therefore enter a soft formation to a degree that is related to the softness thereof. In extremely soft formations into which the scraping means would tend to dig very deeply, the area of contact between the flanks 14 of the elements 11 and the formation will be larger than in the case of less soft formations. Thus, the load on the scraping means 5 will be reduced to a greater extent when the bit meets an extremely soft formation, as compared when meeting a less soft formation. Consequently, the corrective action exerted by the ridge-shaped elements depends on the softness of the formation that is met, and is greatest when the tendency of the bit to dig into the formation is greatest.

It will be appreciated that the ridge-shaped elements are only in operation when the bit passes into a relatively soft formation. During normal drilling, the elements are not in contact with the bottom of the hole being drilled.

It is observed that the ridge-shaped elements are not necessarily designed such that the flank 14 of each element is in a plane perpendicular to the central axis A—A. If desired, these flanks may be on conical surfaces having the central axes thereof coinciding with the central axis A≦A, or form parts of screw-surfaces. Also, the flank 14 of each ridge-shaped element may be on a surface that is not a cylinder surface having the central axis coinciding with the central axis A—A, but is a conical surface with central axis A—A. When necessary, the resistance of the ridge-shaped elements against abrasive forces may be increased by abrasive resistant elements (such as hard metal inserts) that are distributed over the surface of the elements at locations where excessively large abrasive attacks on the elements are expected to take place.

The scraping means 5 may be designed in any form or be manufactured from any material suitable for the purpose. The scraping means may be diamonds (either natural or artificial) and be shaped in any other manner than shown, provided that the scraping edges thereof extend in a single row along one side of each mud channel. The row may be continuous as shown in the drawings, or be interrupted (in which latter case the scraping edges of the various rows should be arranged to scrape the total area of the bottom of the hole to be drilled). Further, the scraping edges of a single row of scraping means 5 need not to be arranged in a plane as shown in FIG. 2 of the drawing. If desired, each row may be situated in a curved surface. Also, the rotationally symmetric surface that is defined by the cutting edges 9 (which surface is identical to the shape of the bottom of the hole that can be drilled by the bit) may be chosen different from the one shown in FIGS. 3 and 4 by means of lines B—B and 9, respectively. This surface may have any form suitable for the purpose and is not necessarily smooth but may have discontinuities. Smooth surfaces are shown in FIGS. 5 and 6. The bit shown in FIG. 5 is designed to drill a hole having a bottom part that is in the form of a semi-sphere with radius R. The bit shown in FIG. 6 cuts a hole with a rotationally symmetric bottom surface comprisng two parts, each with a radius of curvature R in longitudinal section thereof. If desired, at least one of the radii may differ from the value R.

The bit shown in FIG. 7 has an inwardly extending cone surface 20 on which the scraping edges are situated.

In all the examples shown, as well as in all other embodiments of the invention, the elements 11 should be ridge-shaped and be located within the rotationally symmetric surface defined by the scraping edges of the scraping means of the bit. Each flank of each element 11 should be oriented at an acute angle with respect to the said surface. Only in this way, the bit will on the one hand be able to drill in formations that behave plastically, and on the other hand be protected against overloading when entering a relatively soft formation. It is observed, however, that the distance D (see FIG. 3) may be chosen very small (even close to zero) when manufacturing the bit, since then part of the ridge-shaped elements will be in contact with the bottom of the hole during normal drilling, and consequently wear away quickly, thereby increasing the distance D to an operationally acceptable value. Depending on the types of rock that are being drilled, rotations per minute, number of wings, etc., such value may be in the range of about ¼ to about 2 millimeters.

Finally, application of invention is not limited to bits with six wings (a wing being constituted by a cutting means 5 with adjoining mud channel and row of ridge-shaped elements). More than six or less than six wings per bit may be applied as well.

We claim as our invention:

1. Rotary bit for drilling a hole in a subsurface formation, said bit comprising a body with central axis, a plurality of mud flow channels arranged in the outer surface of the body, said channels substantially extending from a place near the central axis to body portions having the largest radius with respect to the central axis, scraping means mounted on the body and having scraping edges for drilling a hole in a subsurface formation, said scraping means extending in a single row along one side of each channel and lining at least part of the wall of each channel, and ridge-shaped elements on the outer surface of the body, the elements being abrasive-resistant, being provided with nonscraping ridges that are located within the rotationally symmetric surface defined by the scraping edges of the scraping means, said ridges substantially extending along circles concentric to the central axis, and having flanks that are positioned at an acute angle with respect to the said symmetric surface.

2. Rotary bit according to claim 1, comprising mud jet nozzles debouching in each of the mud channels in a direction such that the main direction of flow from the majority of the nozzles is along and close to the lining of the channel wall formed by the scraping means.

3. Rotary bit according to claim 2, wherein the flow from each nozzle has a component in the direction towards the scraping means nearest thereto.

4. Rotary bit according to claim 2, wherein the flow from each nozzle has a component in the direction towards the bottom of the hole that can be drilled by the bit.

5. Rotary bit according to claim 4, wherein the scraping edges of the scraping means are arranged such that the bottom of the hole drilled thereby is curved in the longitudinal sections thereof.

6. Rotary bit according to claim 5, wherein the scraping means of a row are arranged to form an uninterrupted scraping edge.

* * * * *